US010619960B2

(12) United States Patent
Cross

(10) Patent No.: US 10,619,960 B2
(45) Date of Patent: Apr. 14, 2020

(54) AMMUNITION FEEDING DEVICE LOCK

(71) Applicant: Wes Cross, San Diego, CA (US)

(72) Inventor: Wes Cross, San Diego, CA (US)

( * ) Notice: Subject to any disclaimer, the term of this patent is extended or adjusted under 35 U.S.C. 154(b) by 63 days.

(21) Appl. No.: 16/047,890

(22) Filed: Jul. 27, 2018

(65) Prior Publication Data

US 2019/0078850 A1 Mar. 14, 2019

Related U.S. Application Data

(63) Continuation-in-part of application No. 15/716,246, filed on Sep. 26, 2017, now Pat. No. 10,151,548, which is a continuation-in-part of application No. 15/703,793, filed on Sep. 13, 2017, now Pat. No. 10,094,632.

(51) Int. Cl.

| | |
|---|---|
| ***F41A 11/00*** | (2006.01) |
| ***F41A 17/38*** | (2006.01) |
| *F41A 3/66* | (2006.01) |

(52) U.S. Cl.

CPC ..... *F41A 11/00* (2013.01); *F41A 17/38* (2013.01); *F41A 3/66* (2013.01)

(58) Field of Classification Search

CPC ..... F41A 17/36; F41A 17/38; F41A 35/06; F41A 11/00; F41A 3/66

USPC ..... 42/18, 50, 6, 108

See application file for complete search history.

(56) References Cited

U.S. PATENT DOCUMENTS

| | | | | |
|---|---|---|---|---|
| 2,081,235 | A | 5/1937 | Hillyard | |
| 2,289,067 | A | 7/1942 | Owsley | |
| 2,956,363 | A | 10/1960 | Montana | |
| 3,415,000 | A | 12/1968 | Josef | |
| 4,429,479 | A | 2/1984 | Johnson | |
| 5,519,954 | A * | 5/1996 | Garrett | F41A 17/38 42/6 |
| 5,636,465 | A | 8/1997 | Johnson | |
| 7,562,482 | B1 | 7/2009 | Johnson | |
| 8,756,845 | B2 | 6/2014 | Harris | |
| 9,651,328 | B1 | 5/2017 | Oglesby | |
| 2005/0000138 | A1 | 1/2005 | Kiss | |
| 2006/0123683 | A1 | 6/2006 | Garrett | |
| 2011/0010977 | A1 | 1/2011 | Cash | |
| 2013/0104440 | A1 | 5/2013 | Addis | |
| 2014/0230297 | A1 | 8/2014 | Larson | |
| 2014/0325886 | A1 | 11/2014 | Mather | |
| 2015/0323271 | A1 | 11/2015 | McGinty | |

(Continued)

*Primary Examiner* — Joshua E Freeman

(74) *Attorney, Agent, or Firm* — Eric Hanscom

(57) ABSTRACT

Broadly, the present embodiment is a magazine locking device. The present embodiment locks a magazine in the magazine well when an AR-15 style rifle's upper and lower receivers are closed together. When an AR-15 style rifle's upper and lower receivers are closed, the present embodiment will allow a magazine to be inserted into the firearm. When a magazine is fully inserted into the magazine well the magazine is fixed in place. In order to release the fixed magazine that is retained in an AR-15 style rifle magazine well by the present embodiment, the upper and lower receivers of an AR-15 style rifle must be opened, or separated. The instant the upper and lower receivers of an AR-15 style rifle are separated the fixed magazine is automatically released. The present embodiment is returned to the closed position when an AR-15 style upper receiver is closed onto the lower receiver.

17 Claims, 18 Drawing Sheets

(56) References Cited

U.S. PATENT DOCUMENTS

| | | | | |
|---|---|---|---|---|
| 2016/0069628 | A1* | 3/2016 | Fluhr | F41A 35/06<br>42/6 |
| 2016/0258696 | A1 | 9/2016 | Fluhr | |
| 2017/0160026 | A1* | 6/2017 | Walther | F41A 3/66 |
| 2017/0284761 | A1* | 10/2017 | Lewis | F41A 3/66 |
| 2018/0017347 | A1* | 1/2018 | Chang | F41A 17/38 |
| 2018/0156556 | A1* | 6/2018 | Wyssen | F41A 35/06 |

* cited by examiner

AMMUNITION FEEDING DEVICE LOCK

CROSS-REFERENCE TO RELATED APPLICATIONS

This application claims priority to U.S. patent application Ser. No. 15/716,246, entitled Ammunition Feeding Device Lock, filed Sep. 26, 2017, and U.S. patent application Ser. No. 15/703,793, entitled Centerfire Rifle Detachable Magazine Release filed Sep. 13, 2017, the contents of which are incorporated by reference.

STATEMENT REGARDING FEDERALLY SPONSORED RESEARCH OR DEVELOPMENT

Not Applicable

BACKGROUND OF THE INVENTION

The present invention is in the technical field of firearms. More particularly, the present invention is in the technical field of ammunition feeding device retention. More particularly still, the present invention is in the field of firearm retention devices that lock or arrest the movement of an ammunition feeding device until the firearm action is disassembled.

Semi-automatic firearms have been known for a long time. The first semi-automatic rifle was introduced in 1885. The M-16 automatic rifle was designed in 1956 and has been used by the military from 1964. A civilian version of the M-16 is known as the AR-15, the AR-15 moniker recognizes the first manufacturer of this style of rifle and is generally used to reference all rifles of this style. Most AR-15 rifles are semi-automatic centerfire rifles. The AR-15, and substantially similar variants manufactured by numerous companies, has been manufactured and sold to civilians for many years.

The ammunition feeding device of an AR-15 style rifle, commonly referred to as a magazine, is used to house ammunition fired by an AR-15 style rifle. The magazine is typically held in an AR-15 style rifle by means of a magazine catch. The magazine is retained in an AR-15 style rifle by the catch until a button is depressed, which releases the magazine.

In recent years there have been many new laws and regulations that apply to the civilian owned AR-15 style rifles. There have also been laws written specifically to address the loading and unloading of an ammunition feeding device or magazine, into an AR-15 style rifle. One such law specific to the loading and unloading of a magazine has called for the disassembly of the firearm action of an AR-15 style rifle before one may release a magazine retained in the AR-15 style rifle. The law describes the process of releasing a magazine by means of removal of the rear takedown pin, thereby allowing the upper receiver to be lifted upwards and away from the lower receiver using the front takedown pin as the fulcrum, thus disassembling the firing mechanism, before the magazine may be removed.

The institution of this and other laws has created an increased need for separation of the two halves of a firearm, by means of pivoting about the front takedown pin. This law has created the necessity for a device that restricts the removal of a magazine until the firearm action has been disabled by virtue of the separation of the upper and lower receivers. The present invention is intended to increase ease and efficiency of removing a magazine while being compatible with all variants of the AR-15 style rifle. As gun-related laws continue to constrain gun use it is expected that this invention will become increasingly valuable as it becomes an even more important part of a gun enthusiast's approach to keeping his/her guns legal.

The present embodiments function is to restrict the removal of a magazine until the action of a firearm is disassembled. Upon disassembly the magazine will become free from the AR-15 style rifle automatically. This process is different from the device described in U.S. Pat. No. 8,756,845 by C. Harris, which describes a method of restricting the removal of a magazine until the action of an AR-15 style rifle is disassembled and a button is depressed. This alternate approach is difficult, cumbersome and does not fit on all AR-15 style rifles. The present embodiment is unique, being designed to automatically release a magazine the moment when the action is disassembled, as well as being designed to fit more variants of AR-15 style rifles by keeping its assembly clear of typical variations in AR-15 style rifle designs.

The present embodiment is held in place by means of a block fastener passing through an oval block and attached to an anchor. The anchor is fixed on the lower receiver. The main body is then attached to the anchor with an anchor pin. The main body pivots about the anchor pin and is sprung by means of a main body spring, which is retained in the main body spring cavity. The main body moves toward or away from the center mass of the weapon when the upper half of the weapon is moved away from the arresting face. This main body has a catch attached that is retained in the main body with a catch pin. The catch pivots about the catch pin, being held in sprung position by the catch spring and catch fastener.

While the aforementioned embodiment is considered a preferred embodiment, an alternate embodiment could consist of differing lengths of the main body with an arresting face, catch and catch fastener, and additional embodiments are contemplated that do not deviate from the central inventive step described in this application.

Another alternate embodiment may be created removing the spring between the anchor and main body and placing that spring on the catch between the lower receiver and the catch, using the sprung catch to push the catch and main body. One could also easily adapt this into alternate embodiments in order to fit on other weapon systems such as AR-10, Armalite, AERO, Bull Pup and other variants that can have their action disassembled in a similar way. These alternate embodiments are incorporated into this application and are considered part hereof.

SUMMARY OF ONE EMBODIMENT

The present embodiment is an ammunition feeding device lock comprising a plug, block fastener, oval block, catch pin, anchor pin, anchor, main body, main body spring, catch, catch spring, and catch fastener. The present embodiments assembly replaces a standard magazine catch or bullet-button on a rifle similar to an AR-15 style rifle. The present embodiment allows for the automatic release of a magazine after the upper and lower receivers are separated.

The present embodiment is intended to be placed in the slot where a standard magazine catch would rest, held in place by an oval block and block fastener on the opposite side of the rifle. The head of the block fastener can be permanently covered by a plug. The embodiment would be in the closed, or fixed magazine, position, when the upper and lower receiver is closed. When the upper and lower receivers are closed the main body's arresting face contacts the upper receiver, which holds the present embodiment it in the closed position. In the closed position, a magazine can be fed into an AR-15 style rifle, and held, because the catch is sprung. The sprung catch will move away, pivoting about the catch pin, when forced on by an inserted magazine. When the magazine is fully inserted and aligned with the catch, the sprung catch will then retain the magazine, all while the main body is in the closed position.

The present embodiment would be in the open position, and have freely released a magazine from an AR-15 style rifle when the upper receiver and lower receiver are separated, allowing the arresting face to be free of the obstruction caused by the upper receiver, and allow the main body to pivot about the anchor pin automatically due to the energy released by the main body spring. When the main body pivots about the anchor pin; the catch, catch spring, catch pin and catch fastener move together with the main body, moving away from a magazine housed in an AR-15 style rifle, allowing the magazine to be free automatically when the two halves are separated.

The present embodiment is moved from the open position back to the closed position by means of closing the upper and lower receiver together. The upper receiver, when motioning closed, comes in contact with the sloped surface on the main body. As the upper receiver moves closed due to the pressure of the upper receiver on the sloped surface on the main body, this causes the main body to pivot about the anchor pin, away from the upper receiver until the arresting face and the face of the upper receiver are parallel and at rest in contact with one another.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter falling within the scope of the following claims, and a reasonable equivalency thereof, which claims I regard as my invention.

DETAILED DESCRIPTION OF THE EMBODIMENT

Figure 1:
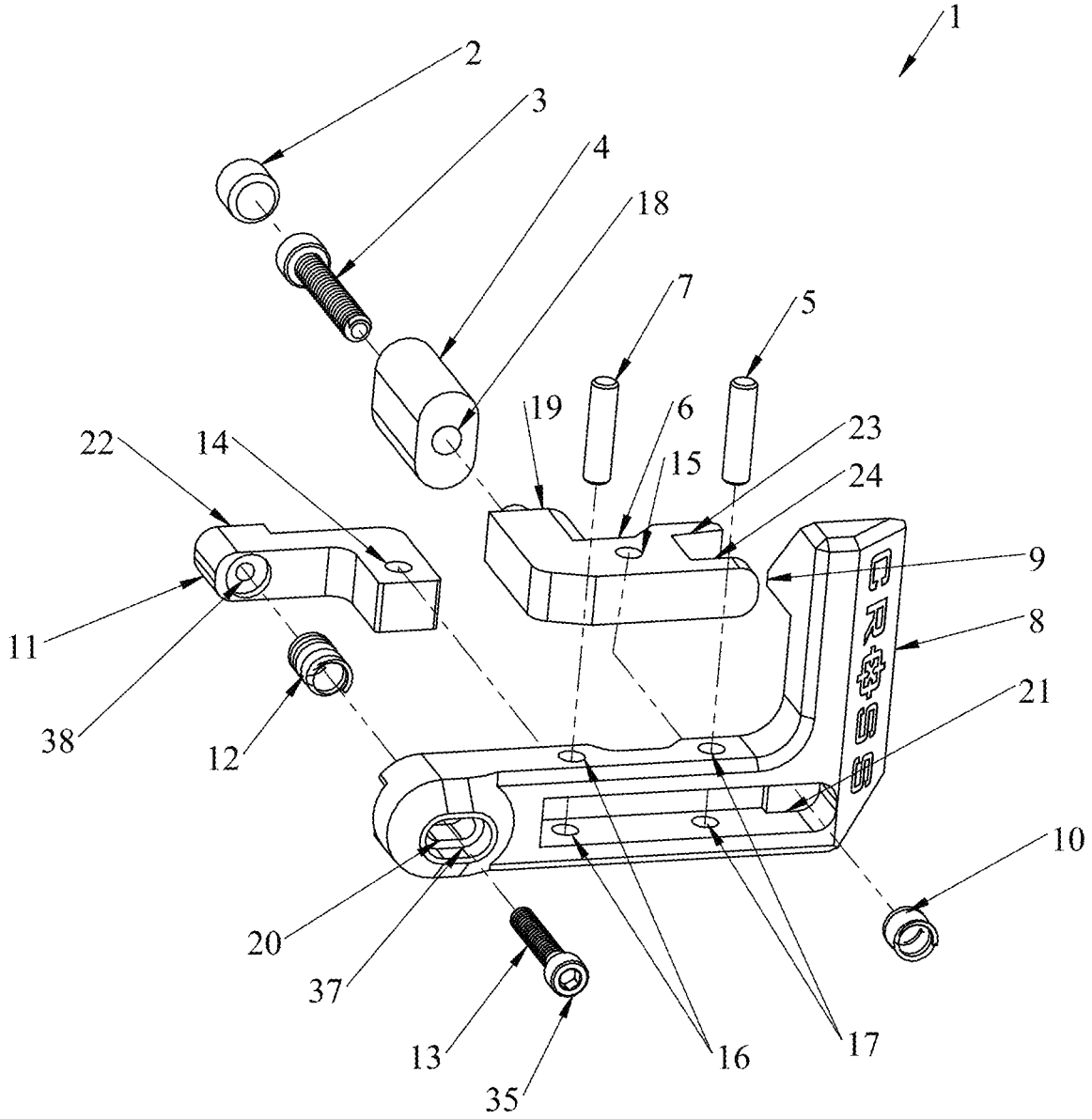
FIG. 1 is an isometric exploded view of present embodiment.

The present embodiment, which is a preferred embodiment, will now be described in detail with reference to the accompanying drawings. In the following description, numerous specific details are set forth in order to provide a thorough understanding of embodiments of the present embodiment. It will be apparent, however, to one skilled in the art, that embodiments may be practiced without some or all of these specific details. In other instances, well known process steps and/or structures have not been described in detail in order to not unnecessarily obscure the present embodiment. The features and advantages of embodiments may be better understood with reference to the drawings and discussions that follow.

Many aspects of the invention can be better understood with references made to the drawings below. The components in the drawings are not necessarily drawn to scale. Instead, emphasis is placed upon clearly illustrating the components of the present invention. Moreover, individuals reference numbers designate the same part or feature through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Since the basic firearm is of a well-known type, only those parts of the firearm essential to an understanding of the present embodiment will be described in detail. Although the present embodiment will be described with reference to the exemplary embodiments shown in the drawings, it should be understood that the present embodiment can be embodied in many alternate forms or embodiments. In addition, any suitable size, shape or type of elements or materials could be used. Indeed, any device that pivots about a rod could benefit from this technology.

The present embodiment is an ammunition feeding device lock, comprising of a plug, block fastener, oval block, catch pin, anchor pin, anchor, main body, main body spring, catch, catch spring, and catch fastener. The present embodiments assembly replaces a standard magazine catch or bullet-button on a rifle similar to an AR-15 style rifle. The present embodiment allows for the automatic release of a magazine after the upper and lower receivers are separated. The present embodiment is intended to be placed in the same slot as the standard magazine catch, replacing a standard magazine catch for an AR-15 style rifle.

The present embodiment has an anchor, fastened to the lower receiver by means of a block fastener, which passes through an oval block. That anchor has a main body attached with an anchor pin, about which the main body pivots. There is a spring captured between the anchor spring retainer and the main body spring cavity. The main body spring forces the main body to open the assembly until it is limited by the anchor stop face. The main body captures a catch, retained by the catch pin. The catch pivots about the catch pin. The distance between the magazine catch face and the main body is adjustable by means of rotating the catch fastener, which is threaded into the catch tapped hole, clockwise or counterclockwise. The distance is maintained by the catch spring, which keeps tension between the main body and catch. To prevent tampering with the block fastener, a plug can be pressed into the oval block.

The present embodiment is in the closed position when the upper and lower receiver of an AR-15 style rifle are close together, and the arresting face of the main body is resting on the upper receiver. In the closed position, the present embodiment may have a magazine inserted and locked in place by inserting the magazine into the magazine well, the magazine will come into contact with the catch, pushing the catch back toward the main body, until the magazine catch slot is aligned with the catch, then the tension from the catch spring will force the catch to fall into the magazine catch slot, locking the magazine in place. The magazine cannot be released without the main body pivoting about the anchor pin, moving the catch away from the magazine.

The present embodiment is moved to the open position by separating the upper and lower receiver, which then moves the upper receiver clear of the arresting face, allowing the main body spring to pivot the main body about the anchor pin. When the main body pivots about the anchor pin in this fashion, the catch moves with the main body, away from the magazine well, automatically releasing the magazine housed in the magazine well.

The present embodiment is moved from the open position back to the closed position by closing together the upper and lower receiver of an AR-15 style rifle. As the upper receiver closes, it makes contact with the sloped face, causing the main body to move out of the path the upper receiver until the arresting face of the main body comes to rest on the upper receiver. he assembly will now be in the closed position.

FIG. 1. Referring now to the present embodiment 1 in more detail. In FIG. 1 there is shown an isometric exploded view of present embodiment 1. The present embodiment 1 consists of: a plug 2, a block fastener 3, an oval block 4 having an oval block through hole 18, a catch pin 7, an anchor pin 5, an anchor 6 having an anchor pin hole 15 and an anchor stop face 23 and a spring retainer 24 and an anchor mount face 19, a main body 8 having an arresting face 9 and a spring cavity 21 and a main body anchor pin holes 17 and a main body catch pin holes 16 and a main body slotted hole 20, a main body spring 10, a catch fastener 13, a catch spring 12, and a catch 11 having a catch tapped hole 38 and a magazine catch face 22 and a catch pin hole 14.

The present embodiment is assembled by inserting the main body spring 10 into the spring cavity 21, then insert the anchor 6 into the main body 8, aligning the anchor pin hole 15 with the main body anchor pin holes 17 while retaining the main body spring 10 with the spring retainer 24, then pressing the anchor pin 5 into the anchor 6 and main body anchor pin holes 17 to retain the anchor 6 in the main body 8. The catch 11 is then inserted into the main body 8 and the catch pin hole 14 and main body catch pin holes 16 are aligned, then insert the catch pin 7 into the main body catch pin holes 16 and catch pin hole 14 to retain the catch 11 in the main body 8. The catch spring 12 is then aligned between the catch tapped hole 38 and the main body slotted hole 20 and the catch fastener 13 partially passes through the main body slotted hole 20, passes completely through catch spring 12, and then screwed into the catch tapped hole 38, retaining the catch spring 12 and fixing the distance between the main body 8 and the magazine catch face 22. The oval block 4 is placed in the AR-15 style rifle magazine release button hole. The oval block throughhole 18 is then aligned with the anchor tapped hole 25 and the block fastener 3 can now partially pass through the oval block throughhole 18 and thread into the anchor tapped hole 25 until tight, fixing the assembly onto an AR-15 style rifle. The plug 2 can now be pressed into the plug hole 26 if the user wishes to prevent tampering.

Figure 2:
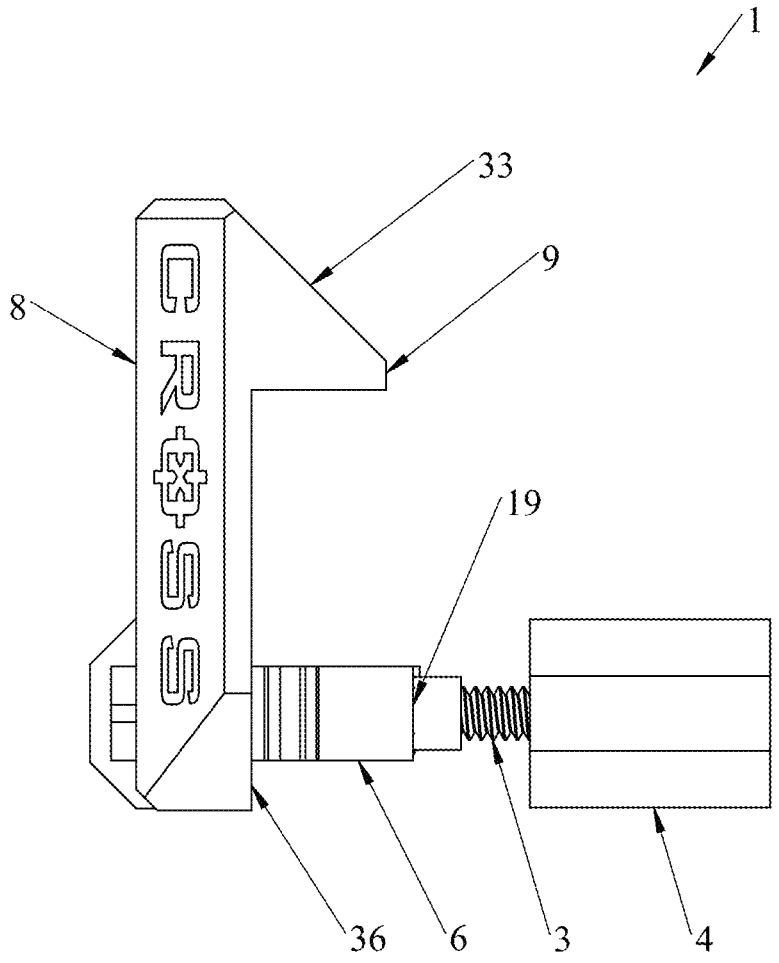
FIG. 2 is a rear view of present embodiment.

FIG. 2. Referring now to the present embodiment 1 in more detail. In FIG. 2 there is shown a rear view of present embodiment 1 in an assembled state. There is shown the main body 8 having a main body stop face 36, a sloped face 33 and an arresting face 9. There is also shown an anchor 6 having an anchor mount face 19. There is also shown a block fastener 3 and an oval block 4.

Figure 3:
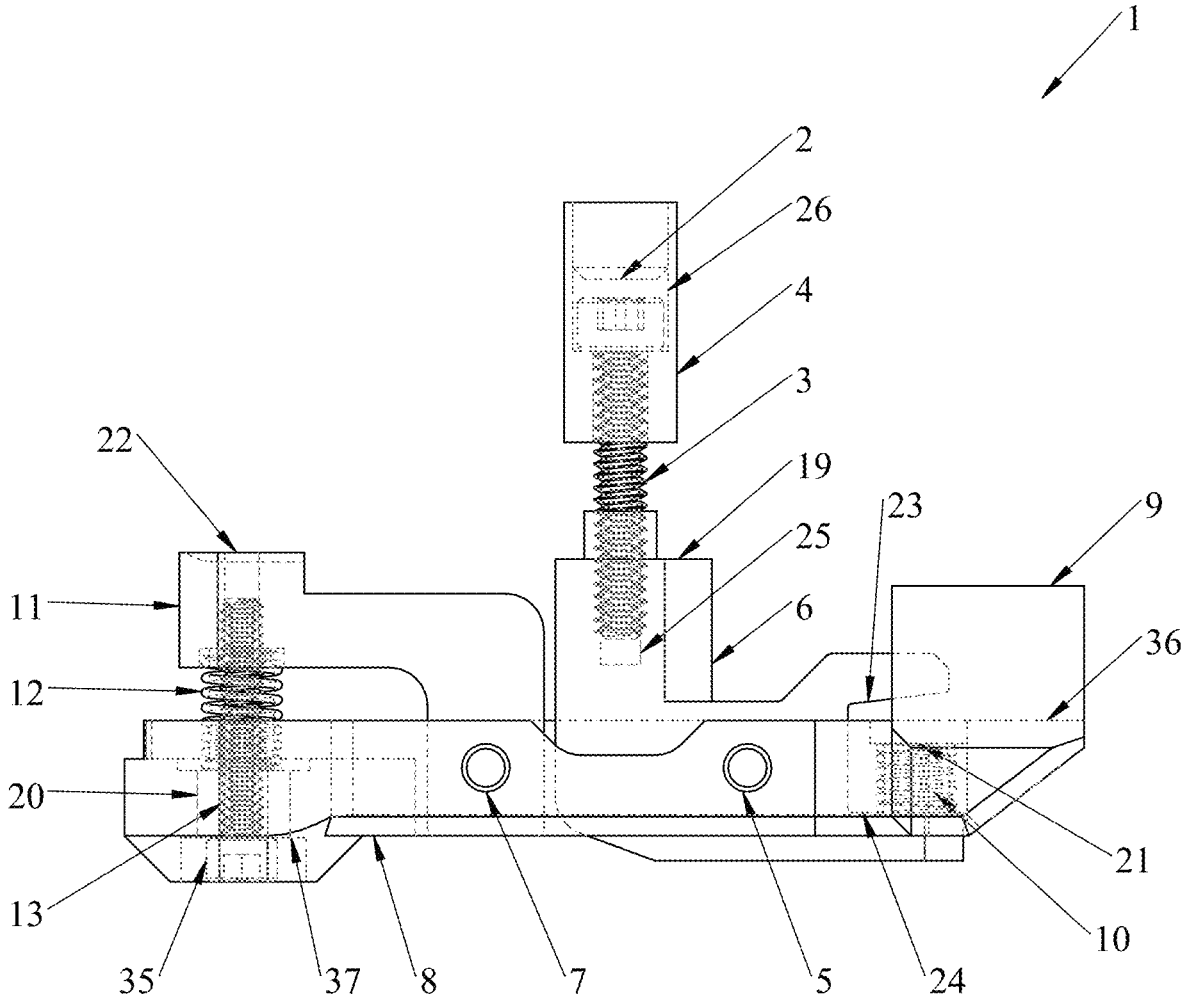
FIG. 3 is a top view with hidden lines dashed.

FIG. 3. Referring now to the present embodiment 1 in more detail. In FIG. 3, there is shown the present embodiment 1 in an assembled and closed state, with hidden lines shown. The main body spring 10 can be seen, held captive by the spring retainer 24 and the spring cavity 21. When there is no impedance of the arresting face 9 the main body spring 10 forces the main body 8 to pivot about the anchor pin 5. The motion of the main body 8 is stopped when the main body stop face 36 meets the anchor stop face 23 on the anchor 6. The catch 11 may also move when a force is applied to the magazine catch face 22. A force on the magazine catch face 22 would cause the catch 11 to pivot about the catch pin 7, compressing the catch spring 12 as the catch fastener 13 is pushed outward from the main body 8. When pressure is released from the magazine catch face 22, the catch spring 12 forces the catch 11 back to its original position, stopping when the catch fastener head 35 contacts the fastener stopping face 37. The main body 8 is attached to the anchor 6 by means of the anchor pin 5. The anchor 6 has an anchor tapped hole 25 into which the block fastener 3 is threaded. The block fastener 3 holds the oval block 4 in and the plug 2 may be pressed into the plug hole 26. The block fastener 3 is tightened until the anchor mount face 19 is well secured in the magazine catch area of an AR-15 style rifle.

Figure 4:
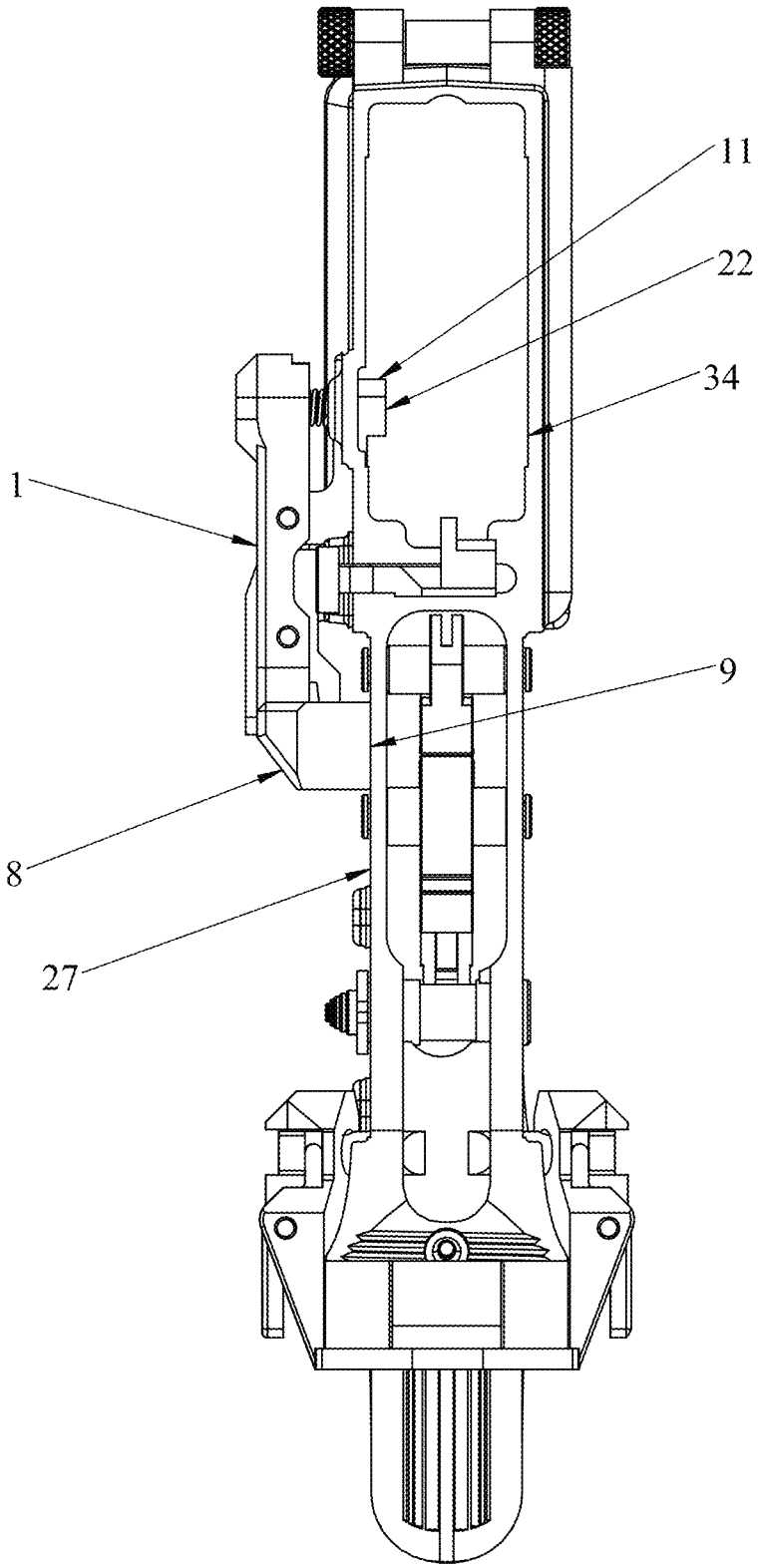
FIG. 4 is a top view of the present embodiment in the closed position, installed on an AR-15 style lower receiver.

FIG. 4. Referring now to the present embodiment 1 in more detail. In FIG. 4, there is shown the present embodiment 1 in the closed position, installed on an AR-15 style rifle. The present embodiment 1 is installed on the AR-15 style lower receiver 27 portion of an AR-15 style rifle. The main body 8 of the present embodiment 1 is in the closed position. In said position the arresting face 9 is parallel to the AR-15 style lower receiver 27. In the closed position, the catch 11 and magazine catch face 22 protrudes into the magazine well 34.

Figure 5:
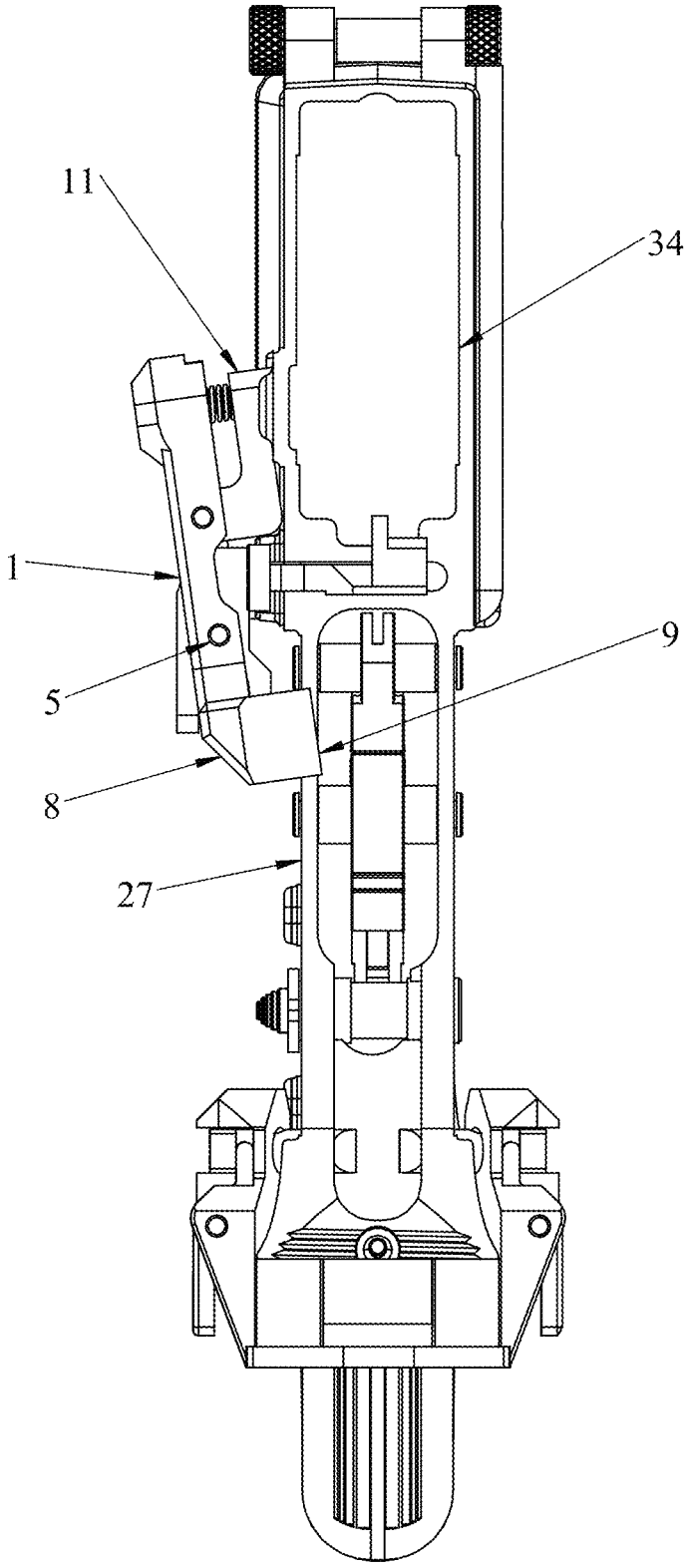
FIG. 5 is a top view of the present embodiment in the open position, installed on an AR-15 style lower receiver.

FIG. 5. Referring now to the present embodiment 1 in more detail. In FIG. 5, there is shown the present embodiment 1 in the open position, installed on an AR-15 style weapon. The present embodiment 1 is installed on the AR-15 style lower receiver 27 portion of an AR-15 style rifle. The main body 8 of the present embodiment 1 is in the open position, in said position the arresting face 9 passes over the AR-15 style lower receiver 27, pivoting about the anchor pin 5. When the main body 8 is in the open position, the catch 11 moves out of the magazine well 34, freeing any magazine that may have previously been held by the catch 11.

Figure 6:
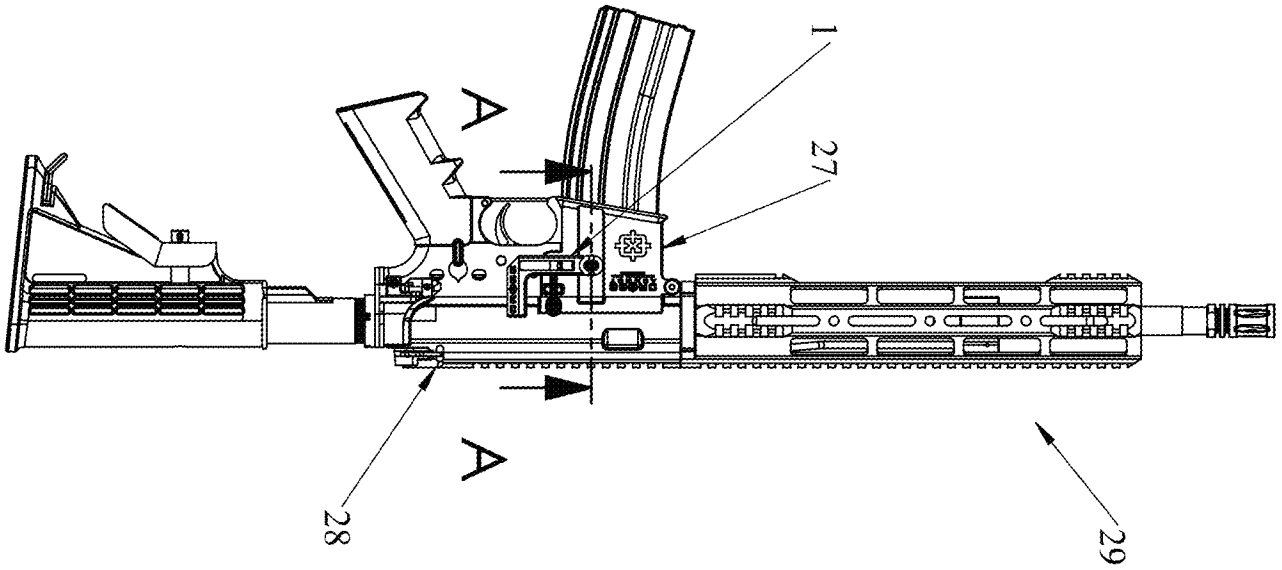
FIG. 6 is a side view of a closed AR-15 style rifle, with the present embodiment installed and in the closed position.

FIG. 6. Referring now to the present embodiment 1 in more detail. In FIG. 5, there is shown the present embodiment 1 installed on an AR-15 style rifle 29. The AR-15 style rifle 29 is in a closed configuration, with the AR-15 style upper receiver 28 closed on the AR-15 style lower receiver 27.

Figure 7:
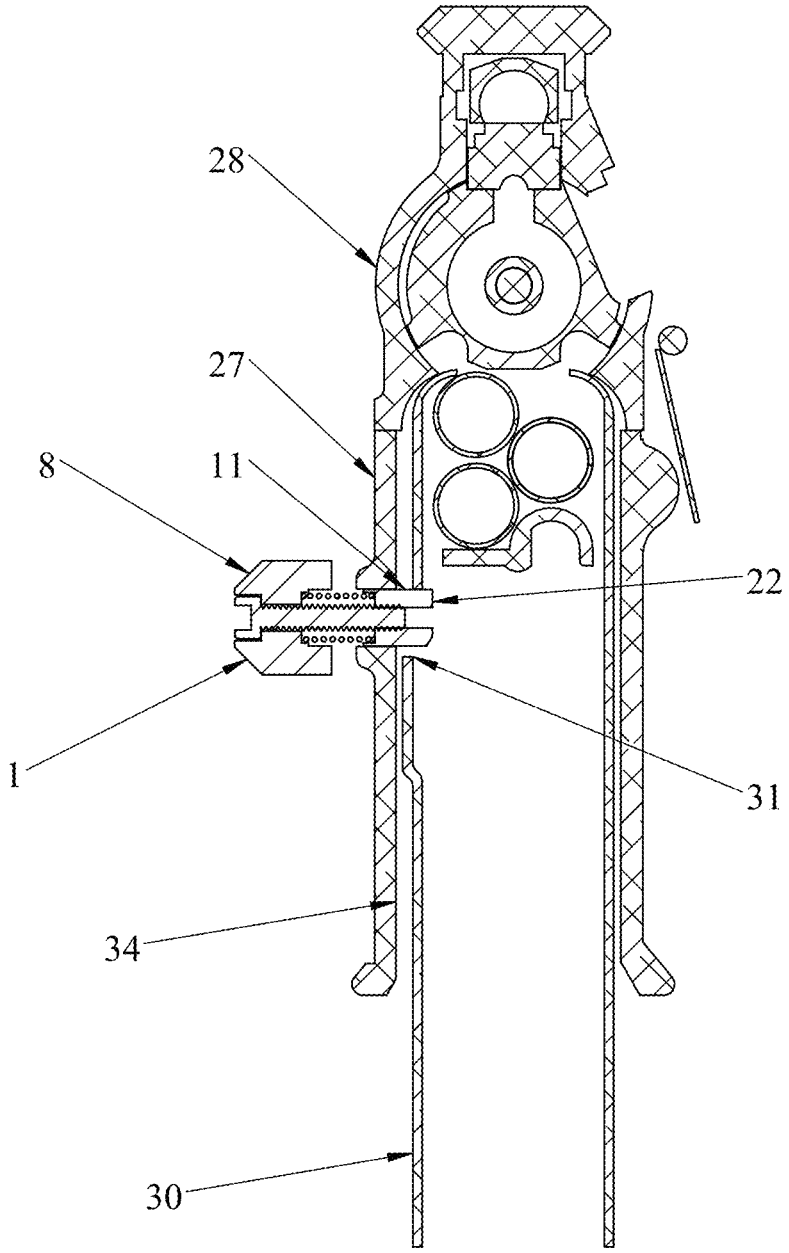
FIG. 7 is section view A from FIG. 6, showing the present embodiment installed in the closed position on a closed AR-15 style weapon.

FIG. 7. Referring now to the present embodiment 1 in more detail. In FIG. 7, there is shown section A from FIG. 6. The AR-15 style upper receiver 28 and AR-15 style lower receiver 27 are shown closed together, in this configuration the present embodiment 1 is forced in the closed position. The magazine catch 11 and catch face 22 will protrude into the magazine well 34 and the magazine catch slot 31 of the magazine 30, that is housed in the magazine well 34. This shown configuration will fix the magazine 30 in the magazine well 34.

Figure 8:
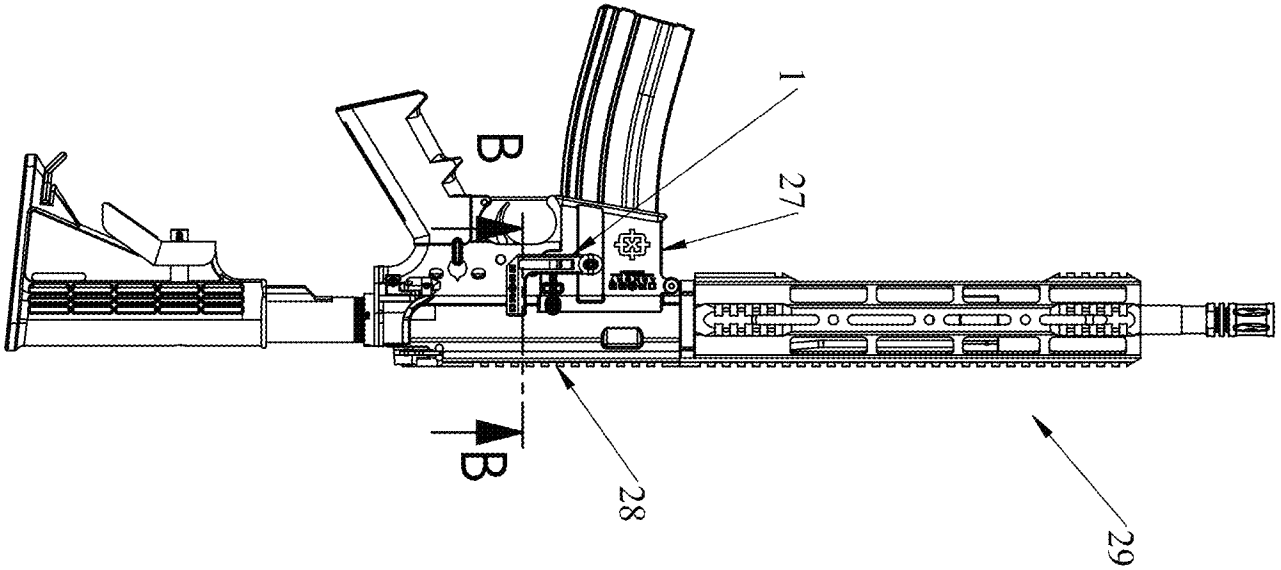
FIG. 8 is a side view of a closed AR-15 style rifle, with the present embodiment installed and in the closed position.

FIG. 8. Referring now to the present embodiment 1 in more detail. In FIG. 8, there is shown the present embodiment 1 installed on an AR-15 style rifle 29. The AR-15 style rifle 29 is in a closed configuration, with the AR-15 style upper receiver 28 closed on the AR-15 style lower receiver 27.

Figure 9:
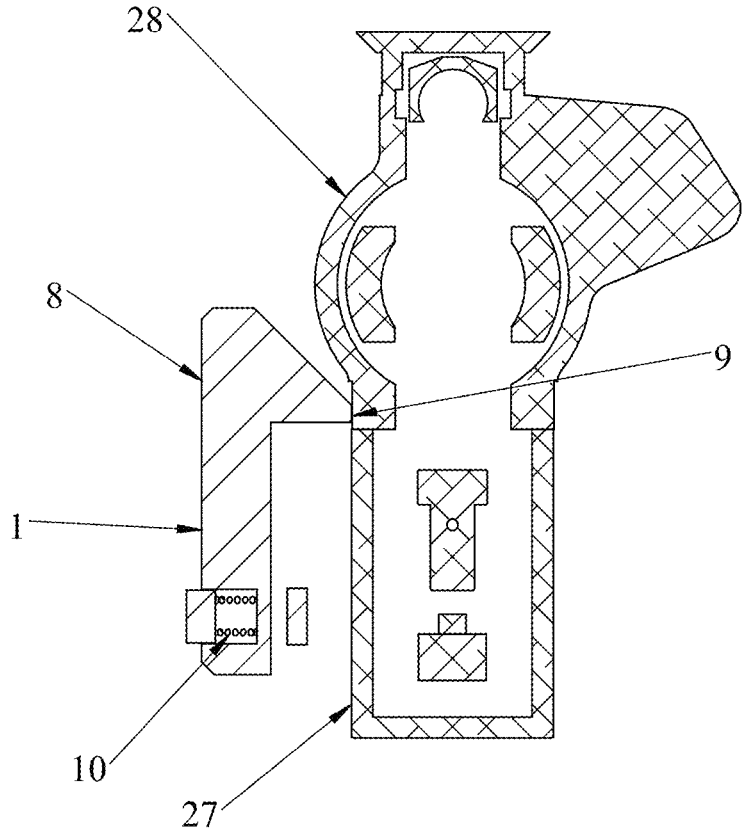
FIG. 9 is section view B from FIG. 8, showing the present embodiment installed in the closed position on a closed AR-15 style lower receiver.

FIG. 9. Referring now to the present embodiment 1 in more detail. In FIG. 9, there is shown section B from FIG. 6. The AR-15 style upper receiver 28 and AR-15 style lower receiver 27 are shown closed together, in this configuration the present embodiment 1 is forced in the closed position. The arresting face 9 of the main body 8 rests on the AR-15 style upper receiver 28. The main body 8 of the present embodiment 1 is held under tension by the main body spring 10, keeping the present embodiment ready to automatically move to the open position when the AR-15 style upper receiver 28 is separated from the AR-15 style lower receiver 27.

Figure 10:
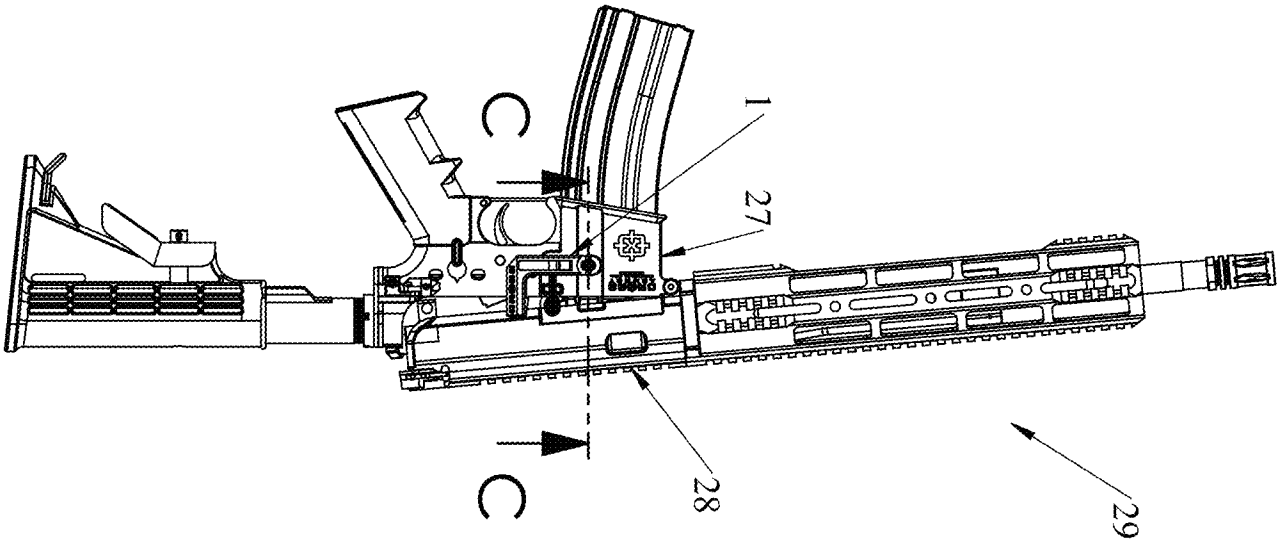
FIG. 10 is a side view of an open AR-15 style rifle, with the present embodiment installed and in the open position.

FIG. 10. Referring now to the present embodiment 1 in more detail. In FIG. 10, there is shown the present embodiment 1 installed on an AR-15 style rifle 29. The AR-15 style rifle 29 is in an open configuration, with the AR-15 style upper receiver 28 open and away from the AR-15 style lower receiver 27.

Figure 11:
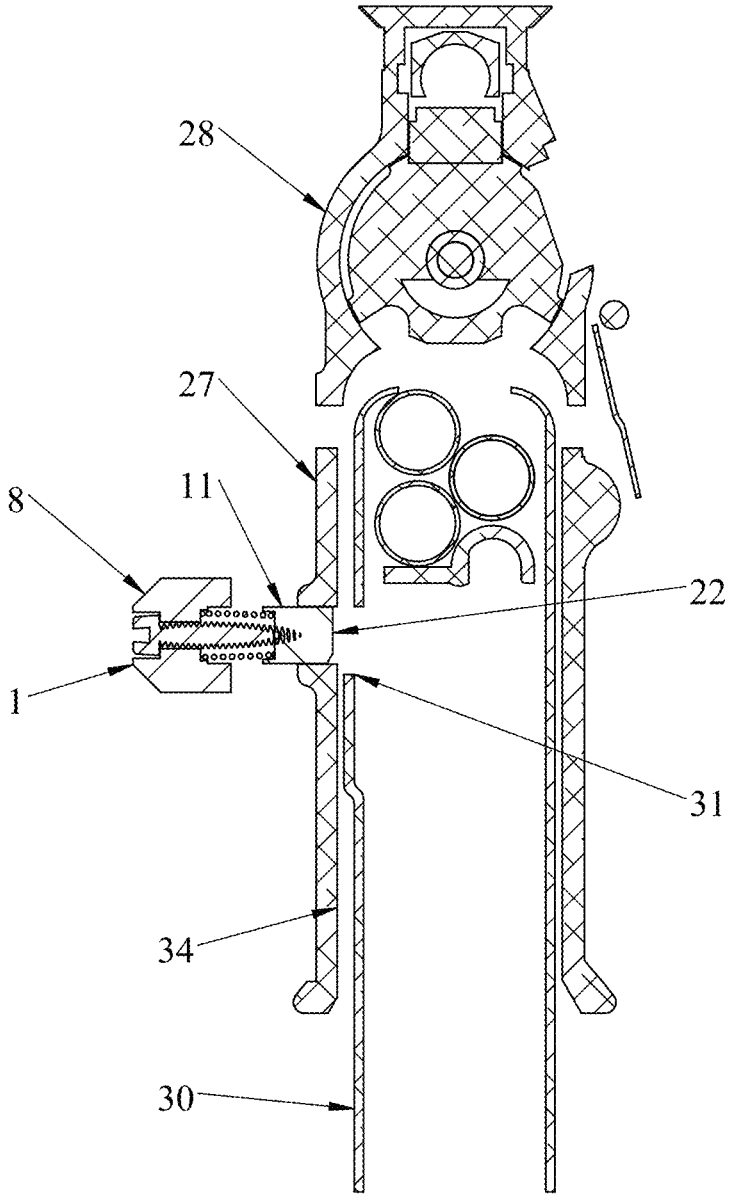
FIG. 11 is section view C from FIG. 10, showing the present embodiment installed in the open position on an open AR-15 style weapon.

FIG. 11. Referring now to the present embodiment 1 in more detail. In FIG. 11, there is shown section C from FIG. 10. The AR-15 style upper receiver 28 and AR-15 style lower receiver 27 are shown open or separated. In this configuration the present embodiment 1 is in the open position. The catch 11 and magazine catch face 22 are pulled away from the magazine well 34 and the magazine catch slot 31 of the magazine 30, that is housed in the magazine well 34. This shown configuration will free the magazine 30 in the magazine well 34.

Figure 12:
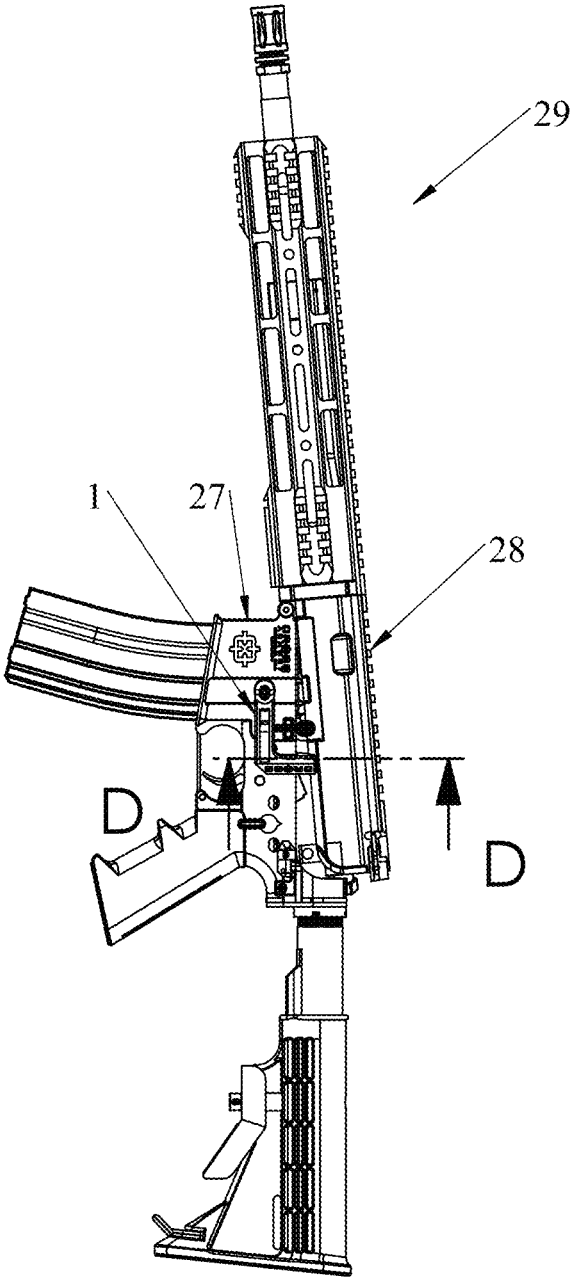
FIG. 12 is a side view of an open AR-15 style rifle, with the present embodiment installed and in the open position.

FIG. 12. Referring now to the present embodiment 1 in more detail. In FIG. 12, there is shown the present embodiment 1 installed on an AR-15 style rifle 29. The AR-15 style rifle 29 is in an open configuration, with the AR-15 style upper receiver 28 open and away from the AR-15 style lower receiver 27.

Figure 13:
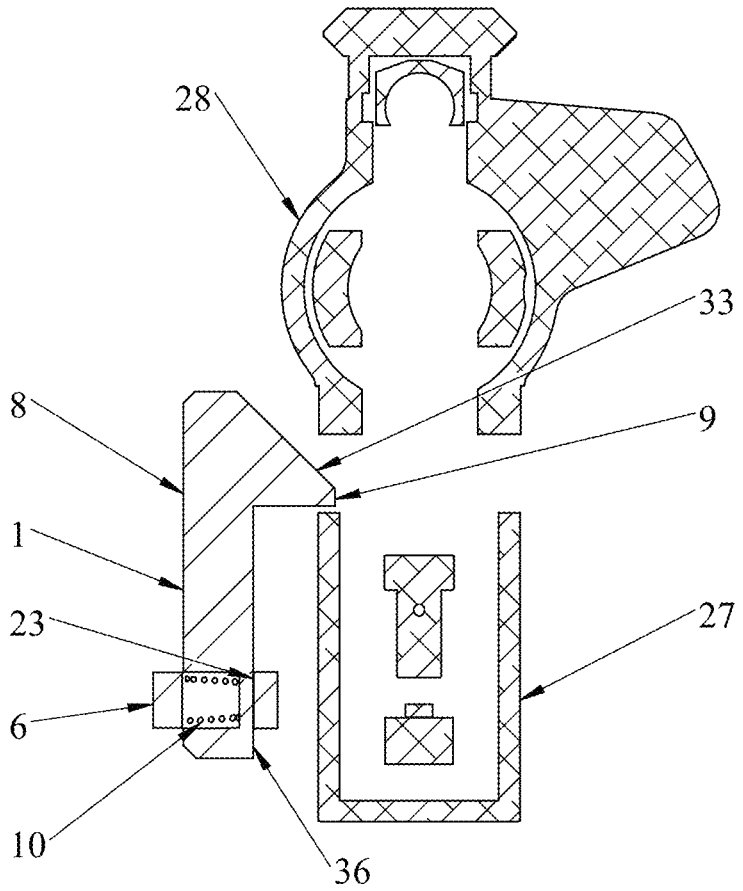
FIG. 13 is section view D from FIG. 12, showing the present embodiment installed in the open position on an open AR-15 style lower receiver.

FIG. 13. Referring now to the present embodiment 1 in more detail. In FIG. 13, there is shown section D from FIG. 6. The AR-15 style upper receiver 28 and AR-15 style lower receiver 27 are shown open or separated in this configuration the present embodiment 1 is in the open position. The present embodiment 1 is installed on the AR-15 style lower receiver 27 portion of an AR-15 style rifle. The main body 8 of the present embodiment 1 is in the open position, in said position the arresting face 9 passes over the AR-15 style lower receiver 27, pivoting about the anchor pin 5. The main body 8 is stopped when the main body stop face 36 and the anchor stop face 23 of the anchor 6 contact each other. When the main body 8 is in the open position, the catch 11 moves out of the magazine well 34, freeing any magazine that may have previously been held by the catch 11. When one desires to move the present embodiment 1 into the closed position, the AR-15 style upper receiver 28 moves down upon the sloped face 33, which causes the main body 8 to move away from the weapon until the AR-15 style upper receiver 28 and the arresting face 9 are parallel and in contact.

Figure 14:
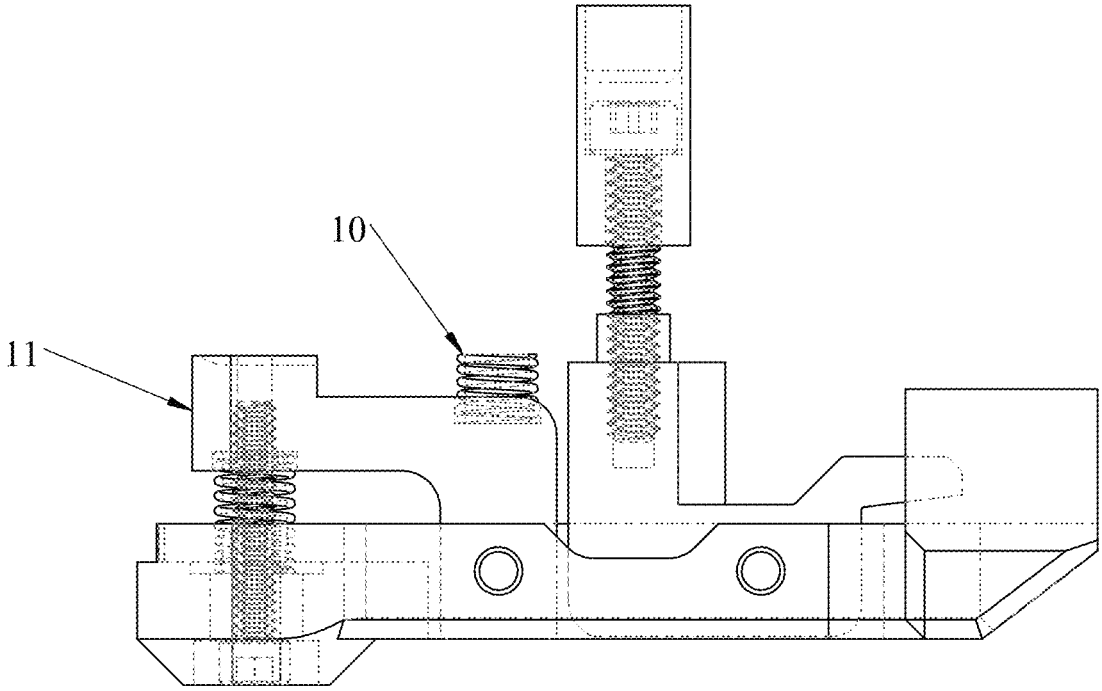
FIG. 14 is an isometric view of an alternate embodiment with an adjustable arresting face.

FIG. 14. Referring now to the present embodiment 1 in more detail. In FIG. 14, there is shown an alternate embodiment. In this embodiment the main body spring 10 is attached to the catch 11, the body spring 10 holding tension against the catch by means of pressure on the AR-15 style rifle to which the alternate embodiment is mounted.

Figure 15:
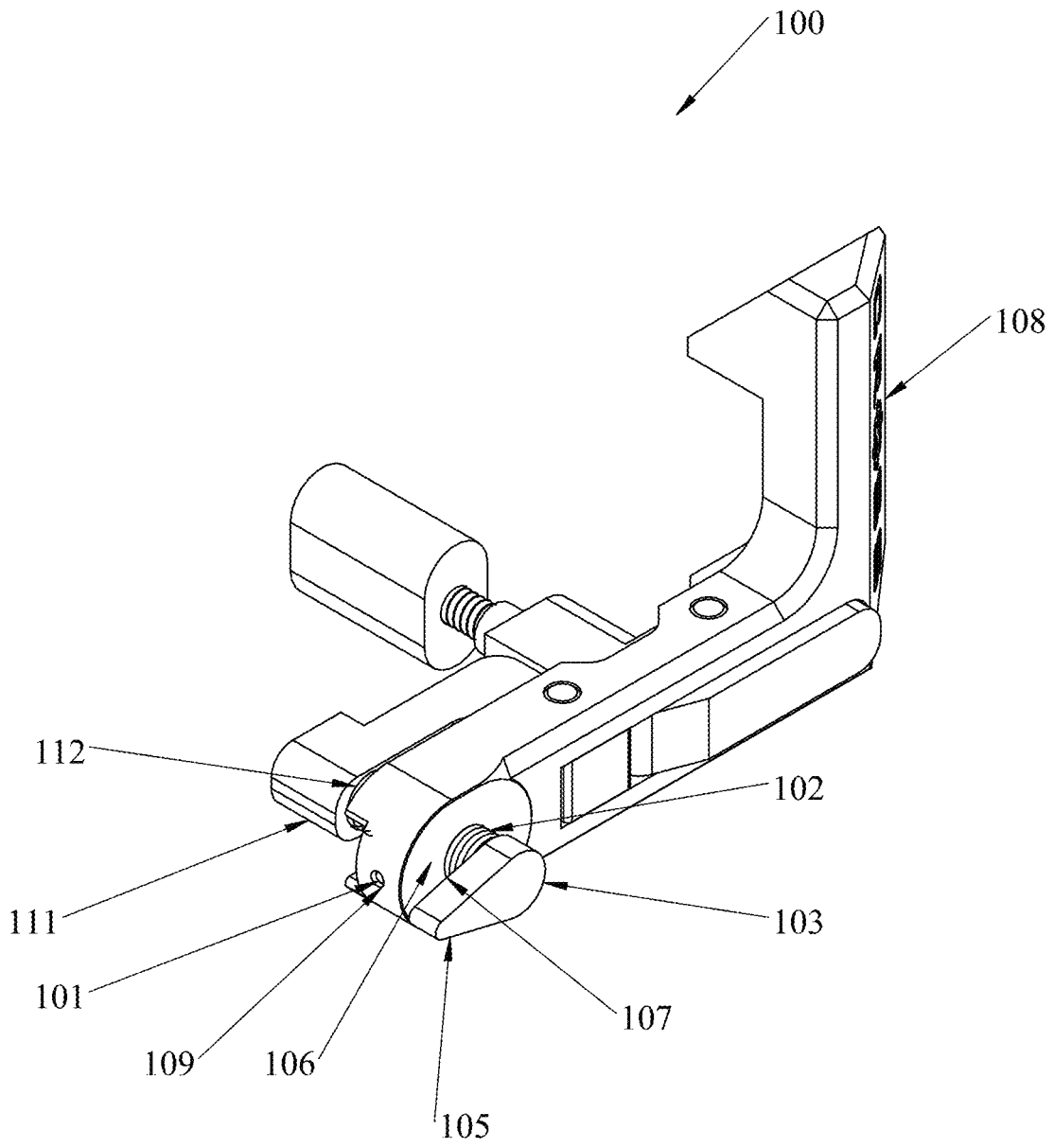
FIG. 15 is an isometric view of an alternate embodiment C with a main pin in the locked position.

FIG. 15 Referring now to an alternate embodiment C 100 in more detail. In FIG. 15, there is shown main body C 108 having a part bearing surface 106 upon which a main pin spring 102 bears on. There is shown a Main Pin 103 that is retained in the main body C 108 by means a detent pin 101 retained in the detent pin hole 109. The main pin spring 102 holds tension between the Min Pin 10 and main body C 108 and bears on the part bearing surface 106 and main pin bearing surface 107. The main pin 103 is shown in the closed position, which is retained by means of pushing the main pin 103 inward toward the spring pocket surface 112 and then turning the main pin 103 with the pin lever 105. As the main pin 103 is depressed inward toward the spring pocket surface 112 of the catch C 111, the detent pin 101 remains stationary and the main pin 103 is allowed motion by means of the free slot 104 that allows the pin to move in and out. When the main pin 103 is depressed in and turned with the pin lever 105, the detent pin 101 is now aligned with the lock slot 110. When the detent pin 101 is aligned with the lock slot 110 the main pin is prevented form in and out motion until such time the pin is rotated so that the detent pin 101 is aligned with the free slot 104, at such time the potential energy of the compressed min pin spring 102 is released and forces the main pin 103 out until it reaches the end of the free slot 104 where its motion is arrested by the detent pin 101. The locked position of the main pin 103 prevents the catch C 111 from pivoting towards the main body C 108 by stopping the catch C 111 on its spring pocket surface 112 making contact with the now fixed and locked main pin 103.

Figure 16:
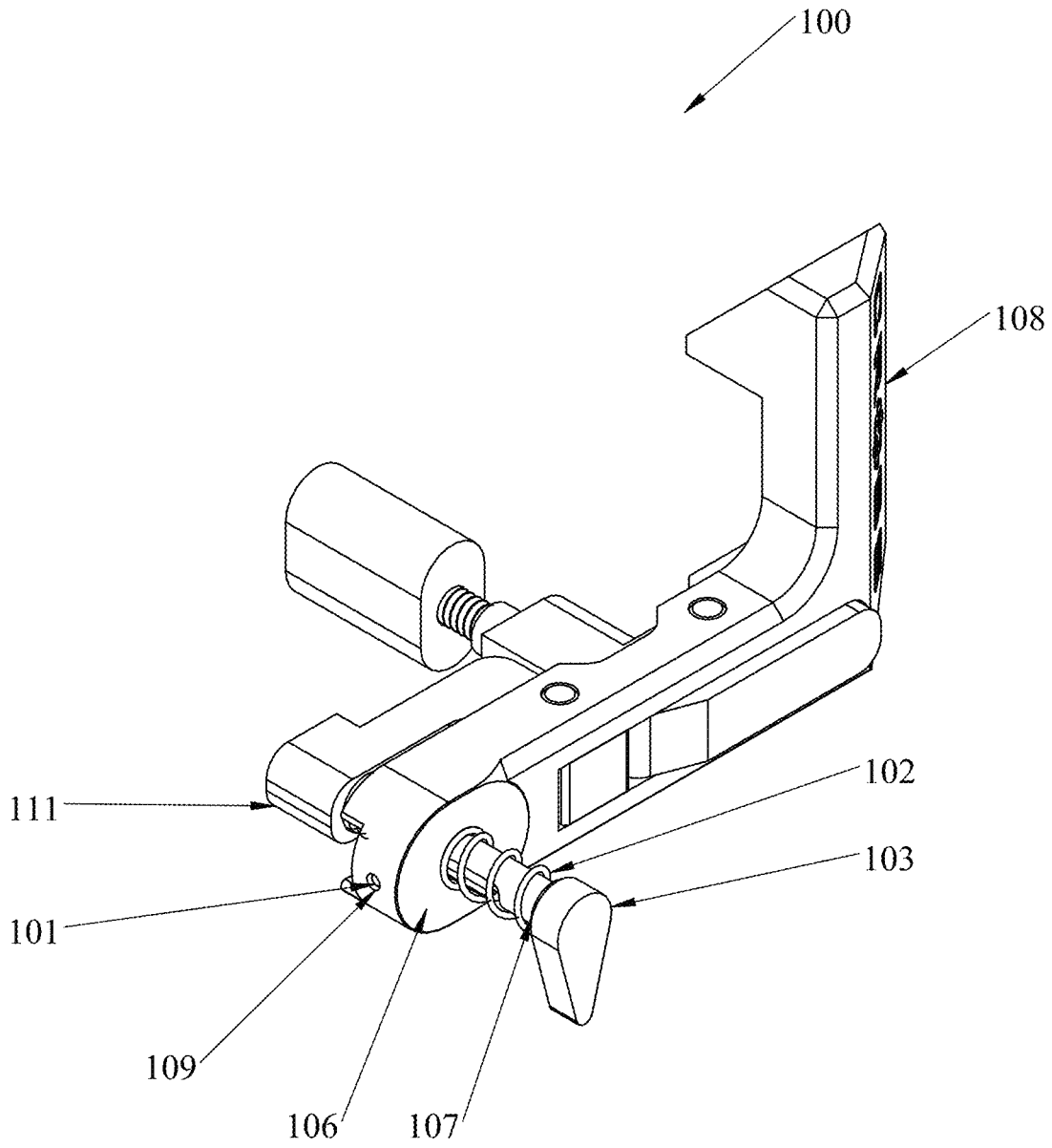
FIG. 16 is an isometric view of an alternate embodiment C with a main pin in the open position.

FIG. 16 Referring now to an isometric view of an alternate embodiment C 100 with a main pin 103 in the open position in more detail. In FIG. 16 there is shown alternate embodiment C 100 having a main pin 103 retained in the main body C 108 by a detent pin 101 aligned in the free slot 104 of the main pin 103. The detent pin 101 is retained in the detent pin hole 109. The main pin 103 is sprung open by the main pin spring 102. The main pin spring 102 bears pressure on the part bearing surface 106 and the main pin bearing surface 107. The detent pin 101 is inside the free slot 104. In this open configuration the catch C 111 can pivot freely without being obstructed by the main pin 103.

Figure 17:
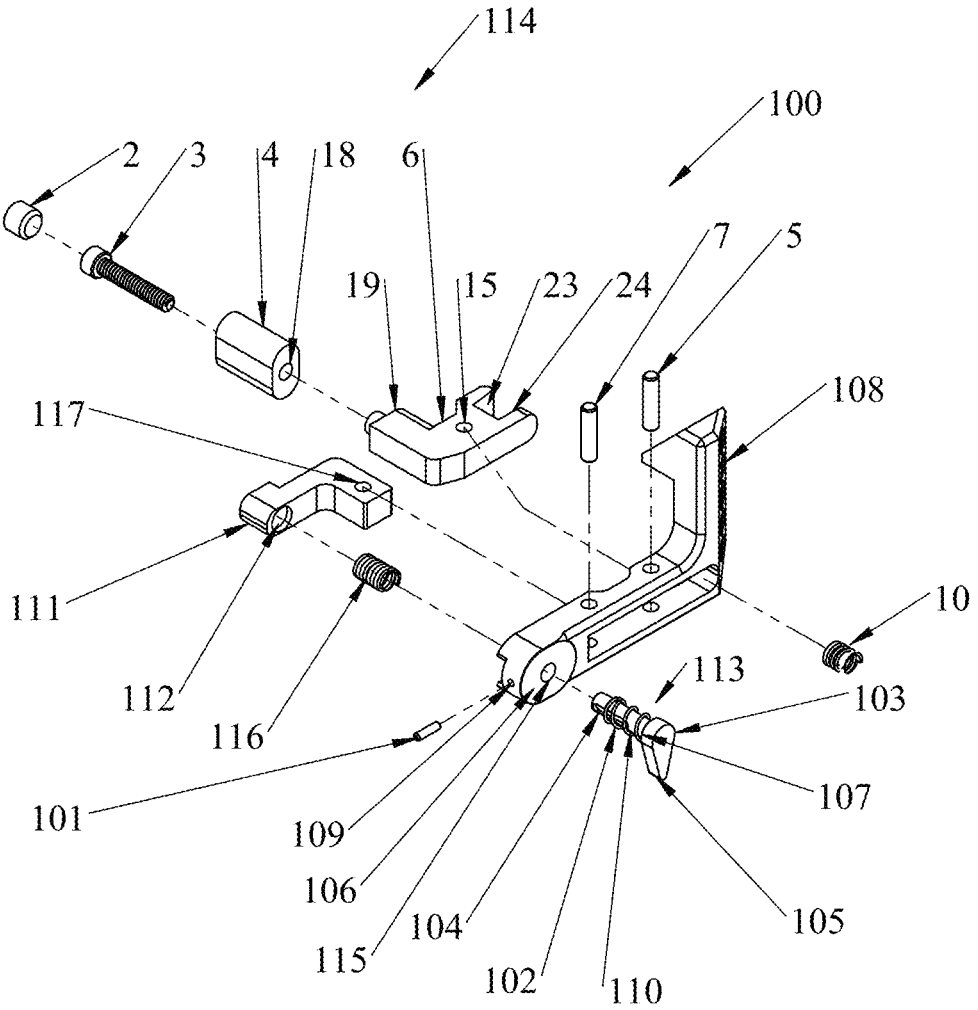
FIG. 17 is an exploded view of alternate embodiment C.

FIG. 17 Referring now to an exploded view of alternate embodiment C 100. In FIG. 17 there is shown alternate embodiment C 100. There is shown a main pin assembly 113 having a main pin 103, a main pin spring 102, a pin lever 105, a main pin bearing surface 107, a lock slot 110, and a free slot 104. There is also shown a min body C 108 having a part bearing surface 106, a detent pin hole 109, and a detent pin 101. There is shown a catch C 111 having a spring pocket surface 112.

Figure 18:
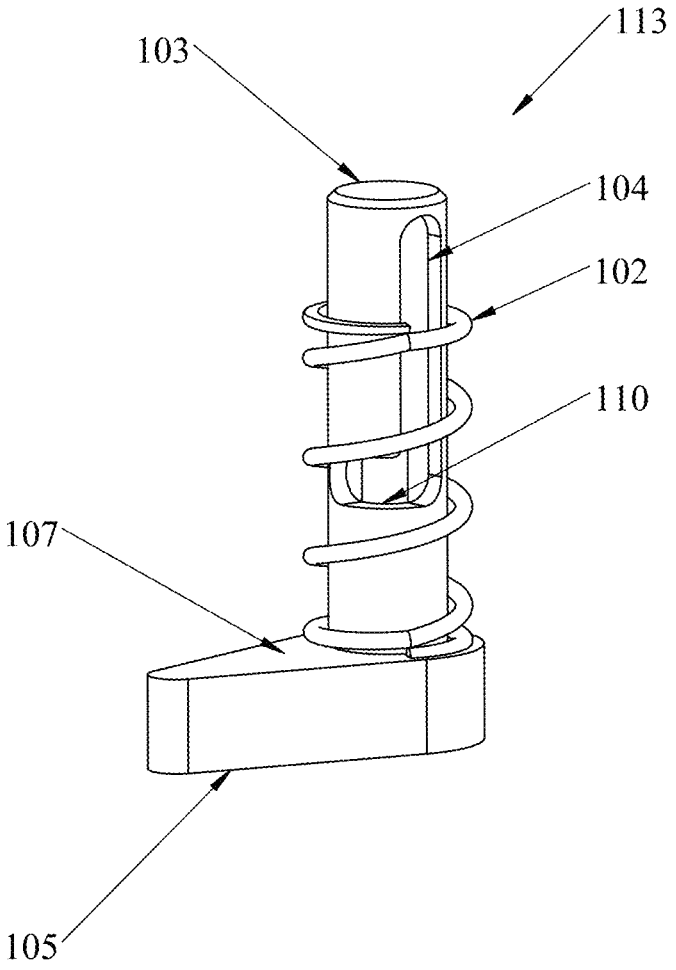
FIG. 18 is an isometric view of a main pin assembly.

FIG. 18 Referring now to an isometric view of a main pin assembly 113. In FIG. 18 there is shown a main pin assembly 113 having a main pin 103. The main pin 103 has a free slot 104, a lock slot 110, a main pin bearing surface 107, a pin lever 105. The main pin 103 has a main pin spring 102 wrapping around it.

BRIEF DESCRIPTION OF OPERATION OF THE EMBODIMENT

The present embodiment locks a magazine in the magazine well when an AR-15 style rifle upper and lower receivers are closed together. When an AR-15 style rifle's upper and lower receivers are closed, the present embodiment will allow a magazine to be loaded into the firearm. When a magazine is loaded with the present embodiment in the closed position the magazine is fixed in the magazine well. In order to release a magazine that is retained in an AR-15 style rifle by the present embodiment, the upper and lower receivers of an AR-15 style rifle must be separated. The instant the upper and lower receivers of an AR-15 style rifle are separated, the magazine is automatically released. The present embodiment is returned to the closed position when an AR-15 style upper receiver is closed onto the lower receiver.

FIG. 7. Referring now to the present embodiment in more detail. In FIG. 7, there is shown section A from FIG. 6. The AR-15 style upper receiver and AR-15 style lower receiver are shown closed together, in this configuration the present embodiment is forced in the closed position. The magazine catch and catch face will protrude into the magazine well and the magazine catch slot of the magazine. This shown configuration will fix the magazine in the magazine well.

FIG. 9. Referring now to the present embodiment in more detail. In FIG. 9, there is shown section B from FIG. 8. The AR-15 style upper receiver and AR-15 style lower receiver are shown closed together. In this configuration the present embodiment is held in the closed position. The arresting face of the main body rests on the AR-15 style upper receiver. The main body of the present embodiment is held under tension by the main body spring, keeping the present embodiment ready to automatically move to the open position when the AR-15 style upper receiver is separated from the AR-15 style lower receiver.

In the closed position, a magazine will be held into an AR-15 style rifle because the catch is sprung by the catch spring. The sprung catch will move away, pivoting about the catch pin, when forced by an inserted magazine. When the magazine is fully aligned with the catch, the sprung catch will then fall into the magazine catch slot, and will be retained, all while the main body is in the closed position.

FIG. 5. Referring now to the present embodiment in more detail. In FIG. 5, there is shown the present embodiment in the open position, installed on an AR-15 style rifle. The present embodiment is installed on the AR-15 style lower receiver portion of an AR-15 style rifle. The main body of the present embodiment is in the open position. In said position the arresting face has rotated over the AR-15 style lower receiver, pivoting about the anchor pin. When the main body is in the open position, the catch moves out of the magazine well, freeing a magazine that has previously been held by the catch.

FIG. 11. Referring now to the present embodiment in more detail. In FIG. 11, there is shown section C from FIG. 10. The AR-15 style upper receiver and AR-15 style lower receiver are shown open or separated. In this configuration the present embodiment is in the open position. The magazine catch and catch face are pulled away from the magazine well and the magazine catch slot of the magazine. This shown configuration will release the magazine from the magazine well.

FIG. 13. Referring now to the present embodiment in more detail. In FIG. 13, there is shown section D from FIG. 6. The AR-15 style upper receiver and AR-15 style lower receiver are shown open or separated. In this configuration the present embodiment is in the open position. When one desires to move the present embodiment to the closed position, the AR-15 style upper receiver moves down upon the sloped face, which causes the main body to move away from the weapon until the AR-15 style upper receiver and the arresting face are parallel and in contact.

All of the material in this patent document is subject to copyright protection under the copyright laws of the United States and other countries. The copyright owner has no objection to the facsimile reproduction by anyone of the patent document or the patent disclosure as it appears in official governmental records but, otherwise, all other copyright rights whatsoever are reserved. While the foregoing written description of the embodiment enables one of ordinary skill to make and use what is considered presently to be the best mode thereof, those of ordinary skill will understand and appreciate the existence of variations, combinations, and equivalents of the specific embodiment, method, and examples herein. The embodiment should, therefore, not be limited by the above described embodiment, method, and examples, but by all embodiments and methods within the scope and spirit of the embodiment.

Referring now to FIG. 17 there is shown alternate embodiment C. This embodiment incorporates a unique pin that is designed to prevent the pivoting of the catch toward the main body. There is shown a Main Pin that is retained in the main body C by means a detent pin retained in the detent pin hole. The main pin spring holds tension between the Min Pin and main body C and bears on the part bearing surface and main pin bearing surface. The main pin is shown in the open position, which can be changed to a locked position by means of pushing the main pin inward toward the spring pocket surface and then turning the main pin with the pin lever. As the main pin is depressed inward toward the spring pocket surface of the catch C, the detent pin remains stationary and the main pin is allowed motion by means of the free slot that allows the pin to move in and out. When the main pin is depressed in and turned with the pin lever, the detent pin is now aligned with the lock slot. When the detent pin is aligned with the lock slot the main pin is prevented form in and out motion until such time the pin is rotated so that the detent pin is aligned with the free slot, at such time the potential energy of the compressed min pin spring is released and forces the main pin out until it reaches the end of the free slot where its motion is arrested by the detent pin.

When the pin is in the locked position the main pin prevents the catch C from pivoting towards the main body C by stopping the catch C on its spring pocket surface making contact with the now fixed and locked main pin.

Advantages

The advantages of the present embodiment include, without limitation, the easy installation of a fixed magazine lock and release device which fits almost all configurations of an AR-15 style rifle.

The present embodiment is also advantageous to those looking to have an easier way to reload, by automatically releasing a magazine. The present embodiment is an improvement on typical methods which require the depression of a button to release a magazine.

The present embodiment is also advantageous to those looking to become compliant with their state laws by means of having a fixed magazine locking device that can only be released when the upper and lower receivers are separated, thus disassembling the firearm action.

The advantages of the alternate embodiment C is that the main pin can be locked. Locking the main pin prevents the catch C form pivoting inward toward the main body C. Preventing this motion will ensure that any magazine held by the catch C will not unintentionally come free by means of overpowering the spring tension holding it in place and pivoting inward.

DRAWINGS—REFERENCE NUMERALS

1. Present embodiment
2. Plug
3. Block Fastener
4. Oval Block
5. Anchor Pin
6. Anchor
7. Catch Pin
8. Main Body
9. Arresting Face
10. Main Body Spring
11. Catch
12. Catch Spring
13. Catch Fastener
14. Catch Pin Hole
15. Anchor Pin Hole
16. Main Body Catch Pin Holes
17. Main Body Anchor Pin Holes
18. Oval Block Through Hole
19. Anchor Mount Face
20. Main Body Slotted Hole
21. Spring Cavity
22. Magazine Catch Face
23. Anchor Stop Face
24. Spring Retainer
25. Anchor Tapped Hole
26. Plug Hole
27. AR-15 Style Lower Receiver
28. AR-15 Style Upper Receiver
29. AR-15 Style rifle
30. Magazine
31. Magazine Catch Slot
32. Front Takedown Pin
33. Sloped Face
34. Magazine Well
35. Catch Fastener Head
36. Main Body Stop Face
37. Fastener Stopping Face
38. Catch Tapped Hole
100. Alternate Embodiment C
101. Detent Spring
102. Main Pin Spring
103. Main Pin
104. Free Slot
105. Pin Lever
106. Part Bearing Surface
107. Main Pin Bearing Surface
108. Main Body C
109. Detent Pin Hole
110. Lock Slot
111. Catch C
112. Spring Pocket Surface
113. Main Pin Assembly
114. Anchor System
115. Part Bearing Surface Hole
116. Catch Spring
117. Catch Pin Hole

What I claim is:

1. An Ammunition Feeding Lock Device comprising a main pin assembly, where the main pain assembly comprises a main body, a catch, a main pin spring, a pin lever, a main pin bearing surface, a lock slot, and a free slot; where the free slot is in the shape of an "L", with a vertical portion and a horizontal portion, where the vertical portion is longer than the horizontal portion; and where the main body additionally comprises a part bearing surface, and where the free slot engages the main body, where a user can press inward, toward the firearm, on the pin lever, against the tension supplied by the main pin spring, until the user can rotate the pin lever to temporarily retain the detent pin in the horizontal portion of the free slot; and where when the device is moved to an open position by separating an upper and a lower receiver, and the pin lever is rotated, the upper receiver is moved clear of the arresting face, thereby allowing the main body spring to pivot the main body about the anchor pin, such that the catch moves with the main body, away from a magazine well, automatically releasing a magazine housed in the magazine well.

2. An Ammunition Feeding Lock Device comprising a main body, a catch, and a main pin assembly, where the main body additionally comprises a part bearing surface, and where the main pain assembly comprises a main pin spring, a pin lever, a main pin bearing surface, a lock slot, and a free slot, where the free slot engages the main body, where a user can press inward, toward the firearm, on the pin lever, against the tension supplied by the main pin spring, until the user can rotate the pin lever to temporarily retain the detent pin in the horizontal portion of the free slot, where when the device is moved to an open position by separating an upper and a lower receiver, and the pin lever is rotated, the upper receiver is moved clear of the arresting face, thereby allowing the main body spring to pivot the main body about the anchor pin, such that the catch moves with the main body, away from a magazine well, automatically releasing a magazine housed in the magazine well.

3. The device of claim 2, where the main body additionally comprises a part bearing surface, where the part bearing surface additionally comprises a horizontal hole, a detent pin hole, a detent pin, two main body catch pin holes, an anchor pin, a catch pin, where the main body additionally comprises a sloped face, a main body stop face, an arresting face, a spring cavity, a main body spring, two main body anchor pin holes, two main body catch pin holes, a catch fastener that additionally comprises a catch fastener head, a fastener stopping face, a main body slotted hole, and a catch spring.

4. The device of claim 3, where the detent pin is inserted into the detent pin hole, and the anchor pin and the catch pin are inserted into the two main body catch pin holes.

5. The device of claim 4, where, the main pin assembly comprises a main pin spring, a pin lever, a main pin bearing surface, a lock slot, and a free slot, where the main pin assembly is inserted into the horizontal hole of the main body, where the main pin spring provides an amount of resistance between the pin lever of the main pin assembly and the part bearing surface of the main body, where the free slot is in the shape of an "L", with a vertical portion and a horizontal portion, where the vertical portion is longer than the horizontal portion, where the free slot engages the detent pin in the horizontal portion, where a user can press inward, toward the firearm, on the pin lever, against the tension supplied by the main pin spring, until the detent pin is in alignment with the horizontal portion of the free slot, at which point a user can rotate the pin lever to temporarily retain the detent pin in the horizontal portion of the free slot.

6. The device of claim 5, where the main body additionally comprises a part bearing surface, where the part bearing surface additionally comprises a horizontal hole, a detent pin hole, a detent pin, two main body catch pin holes, an anchor pin, a catch pin, where the main body additionally comprises a sloped face, a main body stop face, an arresting face, a spring cavity, a main body spring, two main body anchor pin holes, two main body catch pin holes, a catch fastener that additionally comprises a catch fastener head, a fastener stopping face, a main body slotted hole, and a catch spring.

7. The device of claim 6, where, where the detent pin is inserted into the detent pin hole, and the anchor pin and the catch pin are inserted into the two main body catch pin holes.

8. The device of claim 7, where the catch additionally comprises where the anchor additionally comprises an anchor stop face, a spring retainer, an anchor pin, a catch pin, an anchor pin hole and an anchor mount face, where the oval block additionally comprises a plug, a block fastener, a plug hole, an anchor tapped hole, and an oval block throughhole, where the catch additionally comprises a catch pin hole, a magazine catch face, and a catch tapped hole, where, when the main pin assembly is pressed into the horizontal hole of the main body and the detent pin is restrained in the horizontal portion of the free slot in a "locked position", the catch is prevented from pivoting toward the main body, thereby prevent an accidental release of a magazine from a magazine well.

9. The device of claim 8, where the catch additionally comprises where the anchor additionally comprises an anchor stop face, a spring retainer, an anchor pin, a catch pin, an anchor pin hole and an anchor mount face, where the oval block additionally comprises a plug, a block fastener, a plug hole, an anchor tapped hole, and an oval block throughhole.

10. The device of claim 9 where the catch additionally comprises a catch pin hole, a magazine catch face, and a catch tapped hole, where, when the main pin assembly is pressed into the horizontal hole of the main body and the detent pin is restrained in the horizontal portion of the free slot in a "locked position", the catch is prevented from pivoting toward the main body, thereby prevent an accidental release of a magazine from a magazine well.

11. The device of claim 10, where the anchor is fastened to the lower receiver by means of the block fastener, where the block fastener passes through the oval block, where the anchor has a main body attached with an anchor pin, about which the main body pivots, additionally comprising a spring captured between the anchor spring retainer and the main body spring cavity, where the main body spring forces the main body to open the assembly until it is limited by the anchor stop face, where the main body captures the catch, where the catch is retained by the catch pin, and whereby the catch pivots about the catch pin, where the distance between the magazine catch face and the main body is adjustable by means of rotating the catch fastener in either a clockwise direction or a counterclockwise direction, and where the catch fastener is threaded into the catch tapped hole, where the distance between the magazine catch face and the main body is maintained by the catch spring, which keeps tension between the main body and catch.

12. An Ammunition Feeding Lock Device comprising a main body, a main pin assembly, an anchor system, and a catch, where the main body additionally comprises a part bearing surface, where the part bearing surface additionally comprises a part bearing surface hole, a detent pin hole, a detent pin, two main body catch pin holes, an anchor pin, a catch pin, where the main body additionally comprises a sloped face, a main body stop face, an arresting face, a spring cavity, a main body spring, two main body anchor pin holes, two main body catch pin holes, a catch fastener that additionally comprises a catch fastener head, a fastener stopping face, a main body slotted hole, and a catch spring, where the detent pin is inserted into the detent pin hole, and the anchor pin and the catch pin are inserted into the two main body catch pin holes, and where the main pin assembly comprises a main pin spring, a pin lever, a main pin bearing surface, a lock slot, and a free slot, where the main pin assembly is inserted into the horizontal hole of the main body, where the main pin spring provides an amount of resistance between the pin lever of the main pin assembly, and the part bearing surface of the main body where the free slot is in the shape of an "L", with a vertical portion and a horizontal portion, where the vertical portion is longer than the horizontal portion, where the free slot engages the detent pin in the horizontal portion, where a user can press inward, toward the firearm, on the pin lever, against the tension supplied by the main pin spring, until the detent pin is in alignment with the horizontal portion of the free slot, at which point a user can rotate the pin lever to temporarily retain the detent pin in the horizontal portion of the free slot, where the anchor system additionally comprises an anchor stop face, a spring retainer, an oval block, an anchor pin, a catch pin, an anchor pin hole and an anchor mount face, where the oval block additionally comprises a plug, a block fastener, a plug hole, an anchor pin hole, a spring retainer, and an oval block throughhole, where the anchor pin rotably secures the anchor to the main body when the anchor pin is inserted into the anchor pin hole, where the catch additionally comprises a catch pin hole, a magazine catch face, a spring pocket surface, a catch spring, and a catch tapped hole, where, the catch spring is retained in the spring pocket surface, where the catch is rotably connected to the main body at a location where the catch pin is inserted through the catch pin hole, when the main pin assembly is pressed into the horizontal hole of the main body and through the catch spring, and the detent pin is restrained in the horizontal portion of the free slot in a "locked position", the catch is prevented from pivoting toward the main body, thereby prevent an accidental release of a magazine from a magazine well.

13. The device of claim 12, where, the main body spring is inserted into the spring cavity, and the anchor is inserted into the main body such that the anchor pin hole is aligned with the main body anchor pin holes, and, where the main body spring is retained by the spring retainer, where the anchor pin is inserted into both the anchor and the main body anchor pin holes, thereby retaining the anchor in the main body, where the catch is inserted into the main body and the catch pin hole is aligned with the main body catch pin holes, additionally comprising the catch pin inserted into the main body catch pin holes and catch pin hole, thereby retaining the catch in the main body.

14. The device of claim 13, where the catch spring is aligned between the catch tapped hole and the main body slotted hole, and where the catch fastener partially passes through the main body slotted hole, and passes completely through catch spring, and is screwed into the catch tapped hole, thereby retaining the catch spring and fixing a distance between the main body and the magazine catch face.

15. The device of claim 14, where the oval block is placed in an AR-15 style rifle magazine release button hole and the oval block throughhole is aligned with the anchor tapped hole, and the block fastener is partially inserted through the oval block throughhole and threaded into the anchor tapped hole until it is tight, thereby fixing the assembly onto an AR-15 style rifle, and, where the plug is inserted into the plug hole to prevent tampering.

16. The device of claim 15, where the main body spring is retained between the spring retainer and the spring cavity, and where there is no impedance of the arresting face, the main body spring forces the main body to pivot about the anchor pin, where the motion of the main body is stopped when the main body stop face meets the anchor stop face on the anchor.

17. The device of claim 16, where the catch may move when a force is applied to the magazine catch face, and where a force on the magazine catch face causes the catch to pivot about the catch pin, compressing the catch spring as the catch fastener is pushed outward from the main body, such that when a pressure is released from the magazine catch face, the catch spring forces the catch back to its original position, stopping when the catch fastener head contacts the fastener stopping face, where the main body is attached to the anchor by the anchor pin, and where the anchor has an anchor tapped hole into which the block fastener is threaded, where the block fastener holds the oval block in and the plug is inserted into the plug hole, whereupon the block fastener is tightened until the anchor mount face is well secured in a magazine catch area of a AR-15 style rifle, and, where when the device is moved to an open position by separating an upper and a lower receiver and the pin lever is rotated, the upper receiver is moved clear of the arresting face, thereby allowing the main body spring to pivot the main body about the anchor pin, such that the catch moves with the main body, away from a magazine well, automatically releasing a magazine housed in the magazine well.

* * * * *